US009126380B2

(12) United States Patent
Dittmer et al.

(10) Patent No.: US 9,126,380 B2
(45) Date of Patent: Sep. 8, 2015

(54) CASE ERECTOR WITH REVERSIBLE PICKER AND ERECTOR ASSEMBLY

(75) Inventors: Howard R. Dittmer, Lake Bluff, IL (US); Stephen R. Archer, Gilberts, IL (US); Behzad Jafari, Schaumburg, IL (US)

(73) Assignee: ARPAC, LLC, Schiller Park, IL (US)

( * ) Notice: Subject to any disclaimer, the term of this patent is extended or adjusted under 35 U.S.C. 154(b) by 665 days.

(21) Appl. No.: 13/281,673

(22) Filed: Oct. 26, 2011

(65) Prior Publication Data

US 2012/0102896 A1 May 3, 2012

Related U.S. Application Data

(60) Provisional application No. 61/408,591, filed on Oct. 30, 2010.

(51) Int. Cl.
*B31B 1/00* (2006.01)

(52) U.S. Cl.
CPC ..... *B31B 1/00* (2013.01); *B31B 2201/289* (2013.01); *B31B 2201/295* (2013.01); *B31B 2203/003* (2013.01)

(58) Field of Classification Search
CPC ..... B31B 1/00; B31B 3/00; B31B 11/00; B31B 1/06; B31B 1/78; B31B 1/80; B31B 2201/29; B31B 2201/295; B31B 2201/0264; B31B 2201/283; B31B 2201/287; B31B 2201/288; B31B 2203/003
USPC ..... 493/309, 313, 123, 315; 53/382.1, 53/382.2, 564
See application file for complete search history.

(56) References Cited

U.S. PATENT DOCUMENTS

| | | | | | |
|---|---|---|---|---|---|
| 5,536,231 | A * | 7/1996 | Nilsson | 493/315 |
| 5,689,931 | A * | 11/1997 | Bridges et al. | 53/64 |
| 5,924,968 | A * | 7/1999 | Odenthal | 493/309 |
| 6,913,568 | B2 * | 7/2005 | Frank et al. | 493/309 |
| 7,329,218 | B2 * | 2/2008 | Kisch | 493/309 |
| 7,404,788 | B2 * | 7/2008 | Monti | 493/316 |
| 7,510,517 | B2 * | 3/2009 | Goodman | 493/313 |
| 7,585,265 | B2 * | 9/2009 | Gebhardt et al. | 493/70 |
| 7,788,881 | B2 * | 9/2010 | Johnson et al. | 53/382.1 |
| 8,282,537 | B2 * | 10/2012 | Gebhardt et al. | 493/70 |
| 2004/0162207 | A1 * | 8/2004 | Ruf et al. | 493/309 |
| 2007/0072757 | A1 * | 3/2007 | Goodman | 493/313 |
| 2009/0239726 | A1 * | 9/2009 | Huang | 493/309 |

* cited by examiner

*Primary Examiner* — Andrew M Tecco
(74) *Attorney, Agent, or Firm* — Levenfeld Pearlstein, LLC

(57) ABSTRACT

A case erector system comprises a track, a mounting assembly slidably affixed to the track, a picker and erector assembly removably and reversibly affixed to the mounting assembly, an erector arm in the picker and erector assembly configured to engage a first side of a case, and a picker arm in the picker and erector assembly configured to engage a second side of the case, wherein the erector arm is configured to move to a position generally transverse to the picker arm while both the picker arm and erector arm engage the case unit.

20 Claims, 14 Drawing Sheets

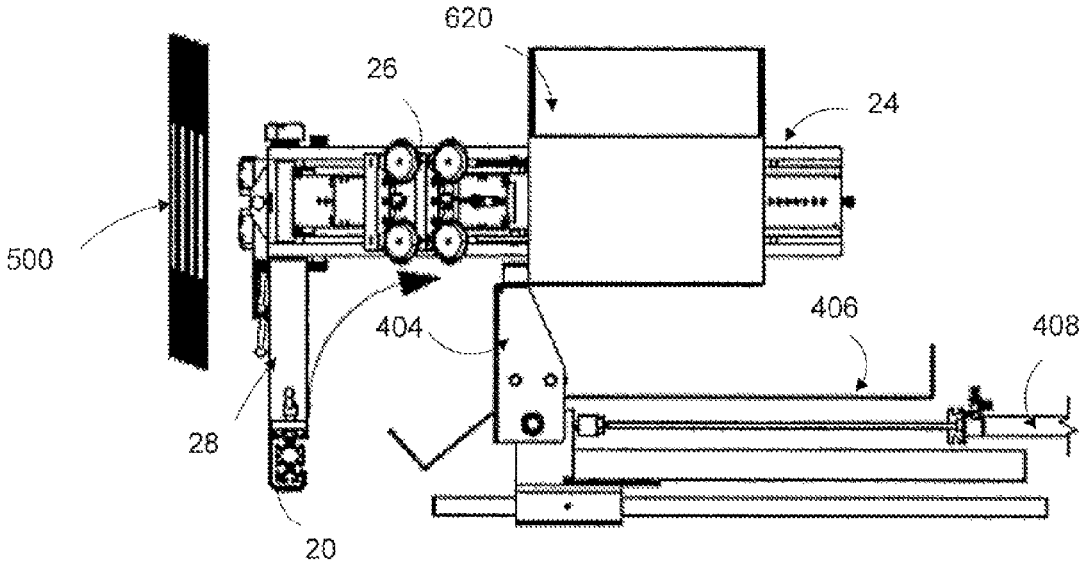
FIG. 10H
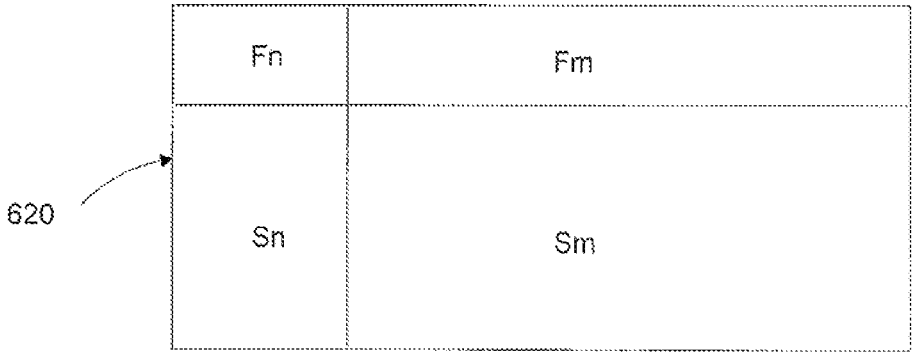
FIG. 11 – PRIOR ART
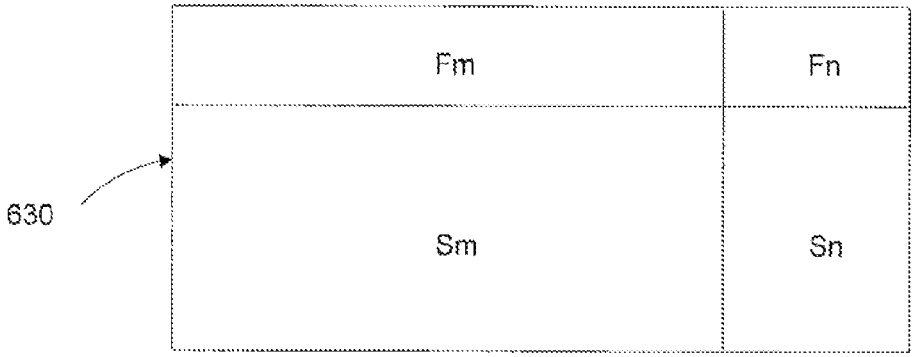
FIG. 12 – PRIOR ART

CASE ERECTOR WITH REVERSIBLE PICKER AND ERECTOR ASSEMBLY

CROSS-REFERENCE TO RELATED APPLICATIONS

This application claims the benefit of U.S. Provisional Application No. 61/408,591, titled "CASE ERECTOR WITH REVERSIBLE PICKER ASSEMBLY," filed on Oct. 30, 2010, the entire contents of which are incorporated herein by reference.

BACKGROUND OF THE INVENTION

The present invention relates generally to packaging equipment, and more particularly to case erectors. The case erector of the present invention comprises a reversible picker and erector assembly and is readily adaptable for erecting (or unfolding) collapsed cases (e.g., cardboard boxes) having different configurations, and it permits a single case erector device to be used to unfold collapsed cases whether the major (longer) side of the case is on the left or on the right.

Cases, such as cardboard boxes, commonly are sold in a folded flat (i.e., a "flattened" or "knocked down") configuration. A case erector is a device that takes a collapsed case from a stack (or "magazine") of collapsed cases (or "blanks") and unfolds it. In most instances, either the unfolded case is brought down over the article(s) to be cased or the article(s) to be cased are brought up into the unfolded case, and the case is subsequently sealed. In other prior art case erectors, the bottom of the case is sealed and product is lowered into the case, and then the top of the case is sealed.

Case erectors as known in the prior art generally comprise picker and erector assemblies that have two arms—a picker arm and an erector arm. The picker arm is configured to remove a single collapsed case from the stack (or "magazine") and to move the collapsed case into the case erector, while the erector arm is configured to open or expand the collapsed case in cooperation with the picker arm.

In prior art case erectors, the picker arm and the erector arm each typically are configured with suction or vacuum cups, which respectively temporarily attach themselves to two adjacent sides of a collapsed case—the major (longer) side (attached by the picker arm) and a minor (shorter) side (attached by the erector arm). The picker arm and erector arm may be pivotally or hingedly connected to one other and integrated into a single linear assembly or, in some prior art case erectors, the picker arm and the erector arm may be independent of one another and configured such that they travel in transverse directions from one another.

Regardless of the particular configuration of the picker arm and the erector arm, the relative movement of the picker arm and the erector arm away from each other acts to expand the collapsed case to create an open case.

Typically when unfolding cases, depending upon their configuration, a case may be an "A" or "B" type as is known in the prior art (examples of such "A" and "B" type cases are shown in FIGS. 11 and 12, further discussed below). In an "A" type case, the major (or longer) side of the case is on the left when the case is fed into the case erector. In a "B" type case, the major (or longer) side of the case is on the right, when the case is fed into the case erector. The type of the case determines whether the case is unfolded to the left or the right.

In prior art case erectors, picker and erector assemblies typically are configured to handle either "A" type cases or "B" type cases, but not both. That is, the relative positioning of the picker arm and the erector arm in prior art case erectors is such that a "B" type case cannot be opened using a picker and erector assembly configured to open "A" type cases, and vice versa. Thus, if it is necessary open both "A" and "B" type cases, two separate case erectors are required, one configured to open cases to the left and one configured to open cases to the right. Accordingly, there is room for improvement within the art.

What is needed, therefore, is a new case erector that is adaptable to be used with both "A" type cases and "B" type cases. Preferably, the case erector comprises a reversible picker and erector assembly that is readily adaptable for erecting collapsed cases, whether such cases open to the left or to the right. More preferably, the picker and erector assembly is removably and reversibly mounted to a mounting assembly that is slidably mounted to a track such that the mounting bracket may be moved to the left side and to the right side of the case erector. More preferably still, the picker and erector assembly comprises a picker arm and an erector arm, where the erector arm is hingedly mounted to the picker arm. Even more preferably, the case erector comprises a pusher bar assembly configured with a cam-driven drop down pusher bar that accommodates the positioning of the picker and erector assembly on either side (left or right) of the case erector. Most preferably, such a case erector has an open, symmetrical structure and inline design that can handle cases of various sizes and that is not limited to picking cases from only one side (left or right) of the case erector. The present invention satisfies this need.

BRIEF SUMMARY OF THE INVENTION

The present invention comprises a case erector with reversible picker and erector assembly. The case erector with reversible picker and erector assembly of the present invention is readily adaptable for erecting (or unfolding) collapsed cases (e.g., cardboard boxes) having different configurations, and it permits a single case erector device to be used to unfold collapsed cases whether the major (longer) side of the case is on the left or on the right. That is, the case erector with reversible picker and erector assembly of the present invention can be configured to open cases whether such cases open to the left or to the right ("A" type cases or "B" type cases).

In the disclosed embodiment, the case erector with reversible picker and erector assembly of the present invention comprises a picker and erector assembly having a picker arm and an erector arm, a mounting assembly to which the picker and erector assembly is removably and reversibly mounted, and a track on which the mounting assembly is slidably mounted. The track extends generally from one side of the frame of the case erector to the other side (in some embodiments, two parallel tracks are provided to provide additional stability). The mounting assembly may be slidably moved to either side of the case erector along the track to allow the picker and erector assembly to be mounted on either side (left or right) of the case erector.

The picker and erector assembly comprises a frame having the picker arm and the erector arm mounted thereto. The picker arm and the erector arm each have at least one, and preferably a plurality of, suction cups (or vacuum heads) disposed thereon and configured to removably attach to a collapsed case to remove the collapsed case from the magazine (the stack of collapsed cases being fed into the case erector) and to open the collapsed case into the shape of a box. The suction cups preferably are pneumatically controlled such that they can be securely attached to the collapsed case and easily detached from the opened case.

The picker arm and the erector arm preferably are hingedly connected to each other such that the picker arm preferably remains fixed against the frame of the picker and erector assembly, while the erector arm is configured to swing outwardly from the picker arm to a position that is approximately transverse from the picker arm. In this manner, after the picker and erector assembly removes a collapsed case from the magazine, movement of the erector arm from a position that is generally collinear to the picker arm to a position that is generally transverse to the picker arm causes the collapsed case to expand into the shape of a box. Movement of the erector arm preferably is controlled by a piston mounted to the frame.

As discussed above, the picker and erector assembly is removably and reversibly mounted to the mounting assembly. In one embodiment, the mounting assembly comprises an axle with a mounting bracket rotatably attached thereto. In this embodiment, the frame of the picker and erector assembly is removably attached to the mounting bracket. This permits the frame to pivotally rotate about the axle, thereby swinging the frame, and the picker and erector assembly, from the side of the case erector (a position generally parallel to the side of the case erector) to the front of the case erector (a position generally transverse to the side of the case erector). In this manner, the picker and erector assembly is able to remove a collapsed case from the magazine and then swing out of the path of the opened case so the opened case can be pushed forward by the pusher bar assembly (as further discussed below).

In another embodiment, the frame of the picker and erector assembly comprises a bore configured to directly engage the axle of the mounting assembly without the mounting bracket. This permits the frame to pivotally rotate about the axle, thereby swinging the frame, and the picker and erector assembly, from the side of the case erector (a position generally parallel to the side of the case erector) to the front of the case erector (a position generally transverse to the side of the case erector).

The mounting assembly is further formed with a track engaging member at its lower end configured to engage the track and to permit the mounting assembly to be slidably moved along the track, from one side of the case erector to the other side. The track engaging member is further configured to lockably engage the track when the mounting assembly is positioned in the desired position.

Movement of the picker and erector assembly preferably is controlled by a piston that is fixedly mounted to the frame, but that also is removably mounted to the mounting assembly.

The case erector further comprises a pusher bar assembly configured with a cam-driven drop down pusher bar that allows for positioning of the picker and erector assembly on either side of the case erector. The pusher bar assembly comprises a pusher bar that extends in a direction transverse to the sides of the case erector. One end of the pusher bar comprises a cam follower configured to engage a cam.

When the pusher bar is drawn rearward, preferably by a piston, the cam follower engages the cam and causes the pusher bar to first rise upward from beneath, and adjacent to, the opened case and to then engage the open case and to push it to the next section of the case erector for further processing. When the pusher bar is pushed forward by the piston, the pusher bar drops downward and swings out of the path of the picker and erector assembly so that the next collapsed case may be removed from the magazine. Because the pusher bar assembly is disposed beneath the path of the picker and erector assembly, the picker and erector assembly may be located on either side of the case erector without interfering with the operation of the pusher bar assembly.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIGS. 10A-10H depict front and side views of one embodiment of the case erector system in operation.

FIG. 11 is an elevational view of an "A" type case as is known in the prior art; and, FIG. 12 is an elevational view a "B" type case as is known in the prior art.

DETAILED DESCRIPTION OF THE INVENTION

Figure 1:
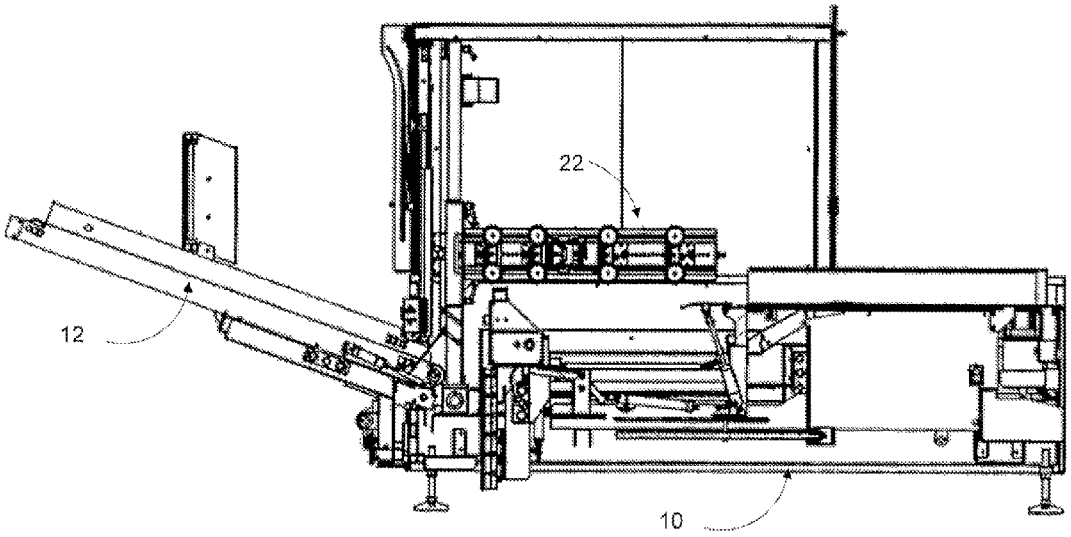
FIG. 1 depicts a side view of one embodiment of a case erector system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

As discussed above, when unfolding cases, depending upon their configuration, a case may be an "A" or "B" type as is known in the prior art. FIGS. 11 and 12 illustrate "A" and "B" type cases as are known in the art.

As shown in FIG. 11, in an "A" type case (or "case unit") 620, the major (or longer) side $S_M$ of the case is on the left when the case 620 is fed into a case erector and the minor (or shorter) side $S_N$ is on the right when the case 620 is fed into a case erector. Additionally, the major (or longer) flap $F_M$ also is on the left when the case 620 is fed into a case erector and the minor (or shorter) flap $F_N$ is on the right when the case 620 is fed into a case erector.

As shown in FIG. 12, in a "B" type case 630, the major (or longer) side $S_M$ of the case is on the right when the case 630 is fed into a case erector and the minor (or shorter) side $S_N$ is on the left when the case 630 is fed into a case erector. Additionally, the major (or longer) flap $F_M$ also is on the right when the case 630 is fed into a case erector and the minor (or shorter) flap $F_N$ is on the left when the case 630 is fed into a case erector.

The type of the case determines whether the case is unfolded to the left or the right. "A" type cases are opened to the right while "B" type cases are opened to the left. The case erector with reversible picker and erector assembly of the present is readily adaptable for erecting (or unfolding) both "A" type cases and "B" type cases. In this manner, only a single case erector device is required, thus eliminating the need to maintain separate case erector devices to handle "A" type cases and "B" type cases.

FIGS. 1-11 show, generally, the case erector with reversible picker and erector assembly 1 (sometimes abbreviated herein as the "case erector") in the preferred embodiment of the present invention.

FIG. 1 depicts a side view of one embodiment of the case erector 1. The case erector system includes a frame 10 and magazine unit (or "case delivery unit") 12 extending from one side of the frame 10. The magazine unit 12 is used to load a plurality of un-erected cases into the case erector system 1.

Figure 2:
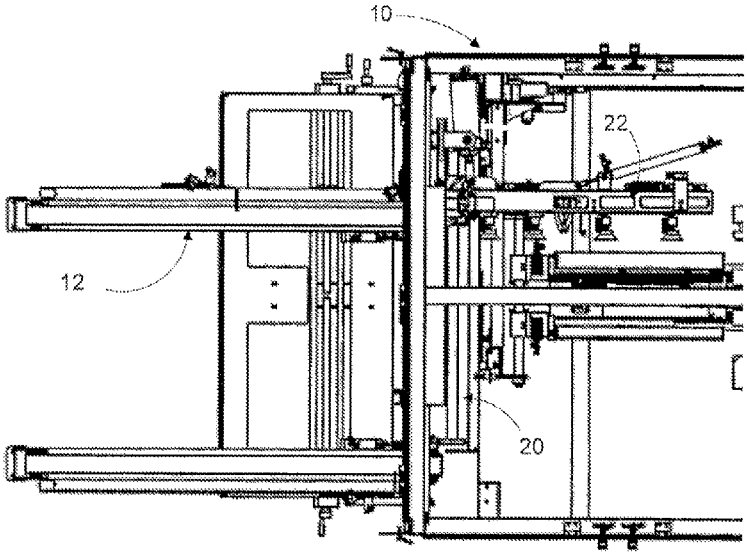
FIG. 2 depicts a top view of one embodiment of a case erector system.

FIG. 2 depicts a top view of the case erector system 1. A track 20 is positioned between two sides of the frame 10 such that the track 20 is perpendicular to the magazine unit 12. The track 20 extends generally from one side of the frame 10 of the case erector 1 to an opposite side. A picker and erector assembly (or "picker and erector unit") 22 is slidably affixed to the track 20 by a mounting assembly (or "mounting unit") 28 (shown in FIG. 3) which allows the picker and erector assembly 22 to slide from one side of the frame 10 (such as the left side) to the other side of the frame 10 (such as the right side).

It will be appreciated by those skilled in the art that some embodiments of case erector system 1 may utilize multiple tracks 20, spaced apart and disposed generally parallel to each other (such as at the upper and lower ends of mounting assembly 28), to provide additional stability to picker and erector assembly 22, and mounting assembly 28 may be configured to accommodate such multiple tracks 20 using multiple track engaging members 322 (discussed below) at the upper and lower portions of mounting assembly 28. All such variations are included within the scope of the instant disclosure.

Figure 3:
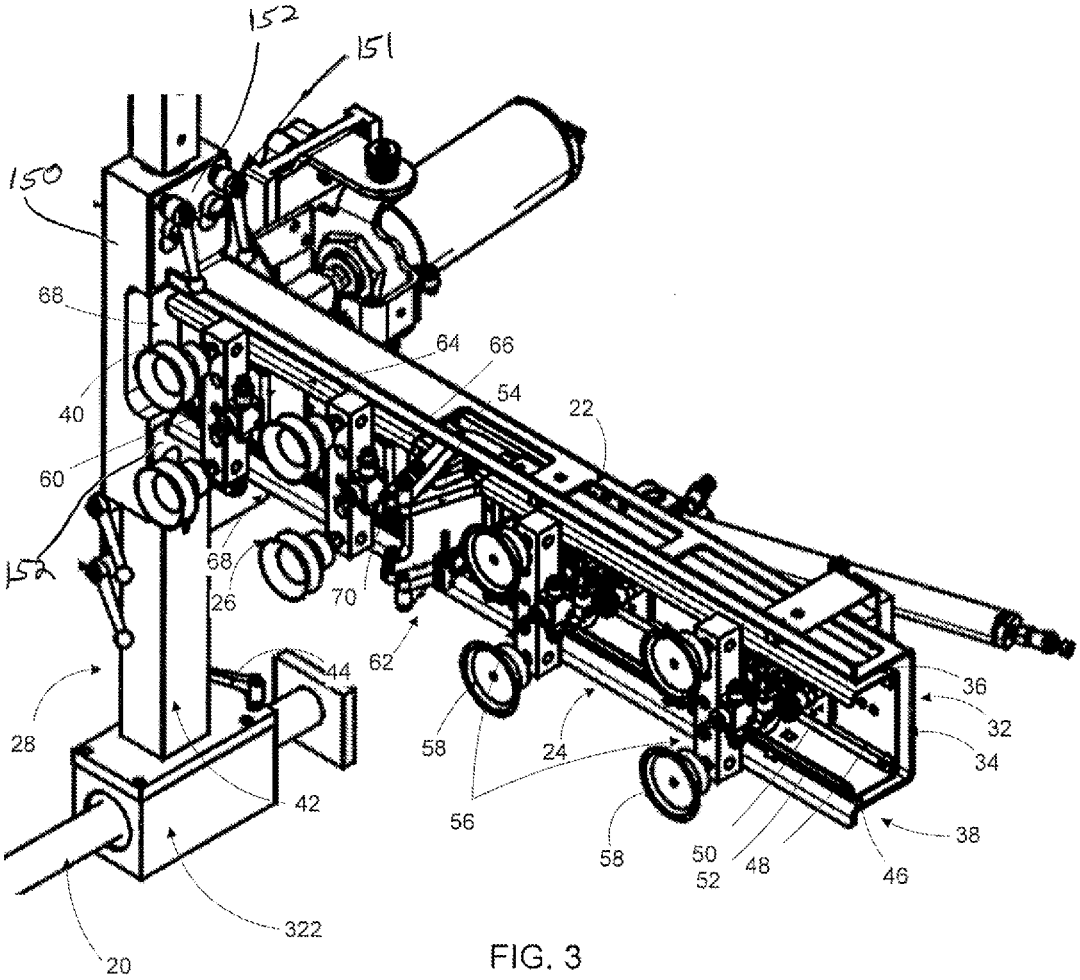
FIG. 3 depicts a front perspective view of one embodiment of a picker and erector assembly.

FIG. 3 depicts a front perspective view of one embodiment of the picker and erector assembly 22 and mounting assembly 28. The picker and erector assembly 22 is removably and reversibly mounted to the mounting assembly 28 and the mounting assembly 28 is slidably mounted to the track 20. The mounting assembly 28 may be slidably moved to either side of the case erector 1 along the track 20 to allow the picker and erector assembly 22 to be mounted on either side of the case erector 1.

The picker and erector assembly 22 includes an exterior support frame 32, a picker arm (or "picker arm unit") 24 and an erector arm (or "erector arm unit") 26. The exterior support frame 32 includes a back plate 34, an upper extension 36 and a lower extension 38. In this embodiment, the frame 32 further comprises upper and lower mounting plates 152 which are configured to removably attach the frame 32 to the mounting bracket 150 of mounting assembly 28 using handle screws 151. The mounting bracket 150 of the mounting assembly 28 is configured to rotatably engage an axle 40 of the mounting assembly 28 such that the picker and erector assembly 22 freely rotates about the axle 40 of the mounting assembly 28 when the picker and erector assembly 22 is mounted to the mounting bracket 150.

Figure 8A:
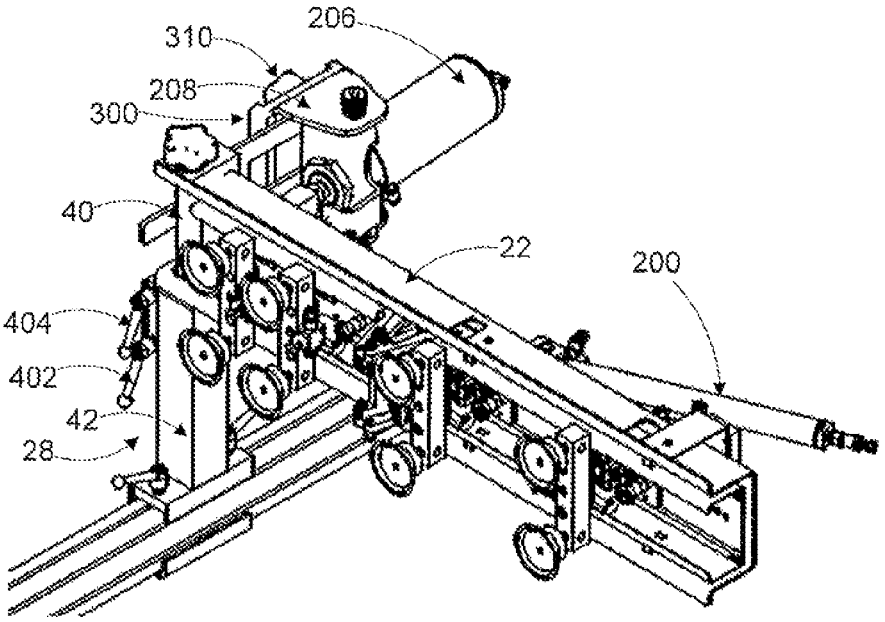
FIGS. 8A-8D depict the reconfiguration of one embodiment the picker and erector assembly.
Figure 8B:
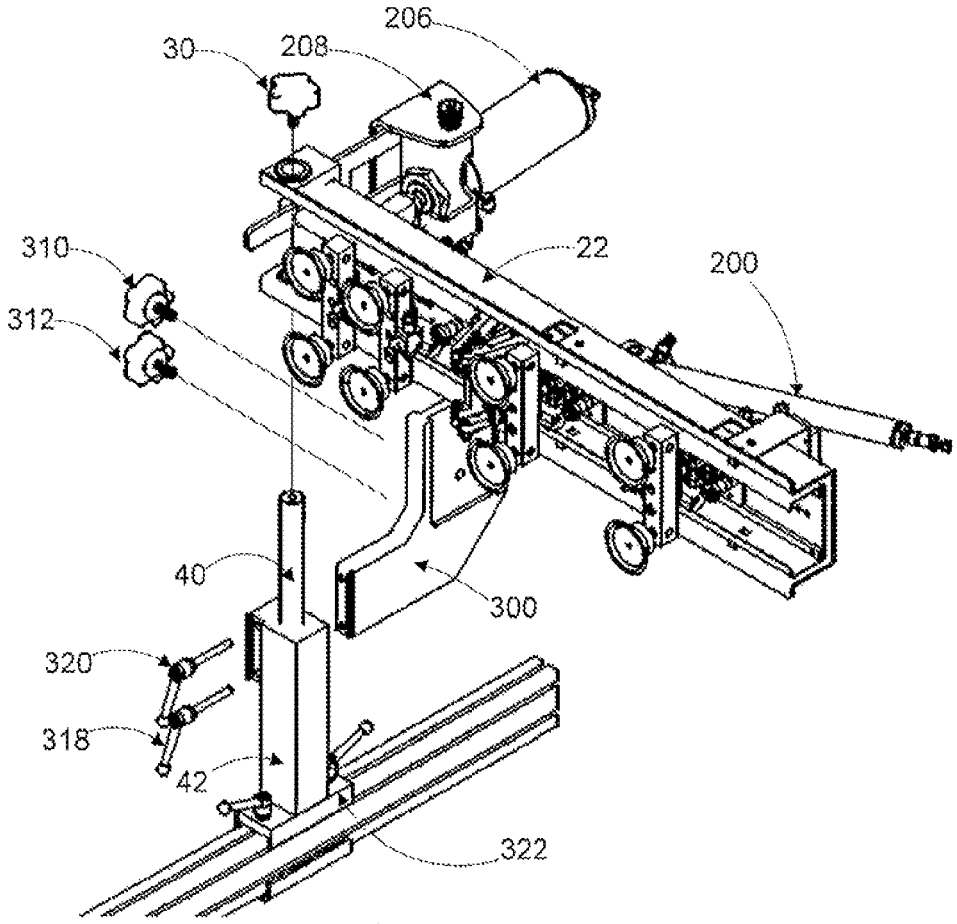

In another embodiment of the picker and erector assembly 22 and the mounting assembly 28 (as shown in FIGS. 8A-8D, for example), one end of the exterior support frame 32 of the picker and erector assembly 22 includes openings in the upper extension 36 and lower extension 38 which are configured to accommodate the axle 40 of the mounting assembly 28 such that the picker and erector assembly 22 freely rotates about the axle 40 of the mounting assembly 28 (without the need for the mounting bracket 150). In this embodiment of the picker and erector assembly 22 and the mounting assembly 28, the axle 40 of the mounting assembly 28 extends above the upper extension 36 of the exterior support frame 32 and the axle 40 is threaded to engage a corresponding threaded portion of the securing mechanism 30 (FIG. 8B). In another embodiment, the axle 40 may be formed with an opening sized to accommodate a pin.

In either embodiment, the mounting assembly 28 includes a lower base portion 42 which is detachably affixed to the track 20 by locking units 44. The lower base portion 42 is substantially square in shape with the axle 40 of the mounting assembly 28 extending from the center of the lower base portion 42. The sides of the lower base portion 42 are arranged such that two sides are substantially parallel with a central axis of the track 20 and two sides are substantially orthogonal with the central axis of the track 20. The side of the lower base portion 42 furthest from the picker and erector assembly 22 includes a plurality of openings for attaching a piston holding plate, as discussed below.

The picker arm 24 includes a support frame 46 which is affixed to the exterior support frame 32 on the side of the exterior support furthest to the mounting assembly 28. The support frame 46 includes a back plate 48 having a substantially rectangular shape with an upper plate 50 and a lower plate 52 extending from the longer sides of the back plate 48. Extension arms 54 are connected to the ends of the upper plate 50 and lower plate 52 of the picker arm 24 that are closest to the mounting assembly 28. The extension arms 54 are substantially "L" shaped with the shorter ends of the extension arms 54 connecting to the upper or lower plates 50, 52 and the longer ends extend of the extension arms 54 extending outward from the back plate 48 at an angle between 75 and 100 degrees.

The picker arm 24 also includes a plurality of suction units (or "suction devices") 56 detachably affixed to the upper and lower plates 50, 52 of the picker arm 24. In one embodiment, each suction unit 56 includes at least two suction cups 58 arranged in parallel with the mounting assembly 28. In another embodiment, each section unit 56 includes at least two suction cups 58 positioned perpendicular with the mounting assembly 28. In another embodiment, each suction unit 56 includes a single suction cup 58.

Each suction unit 56 is secured to the upper and lower plates 50, 52 of the picker arm support frame 46 and includes tubing which connects each of the suction cups 58 on the suction units 56 to a negative pressure source (not shown). Such suction cups 58 are known in the art and, as also known in the art, preferably are pneumatically controlled such that they can be securely attached to the collapsed case and easily detached from the opened case.

The erector arm 26 includes a support frame 60 which is hingedly affixed to an end of the picker arm 24 furthest from the mounting assembly 28. The erector arm 26 support frame 60 includes a back plate 64 having a substantially rectangular shape with an upper plate 66 and a lower plate 68 extending from the longer sides of the back plate 64. Extension arms 70 are connected to the end of the upper plate 66 and lower plate 68 that face the picker arm 24. The extension arms 70 are substantially "L" shaped with the shorter ends of the extension arms 70 connecting to the upper or lower plates 66, 68 and the longer ends extend of the extension arms 70 extending outward from the back plate 48 at an angle between 75 and 100 degrees.

A plurality of suction units 56 are affixed to the upper and lower plates 66, 68 of the erector arm 26 support frame 60 in the same manner which the suction units 56 are affixed to the picker arm 24. The picker arm 24 and the erector arm 26 preferably are hingedly connected to each other through the hinge unit 62 such that the picker arm 24 preferably remains fixed against the exterior support frame 32 of the picker and erector assembly 22, while the erector arm 26 is able to swing outwardly from the picker arm 24 to a position that is approximately orthogonal to the picker arm 24.

Figure 4:
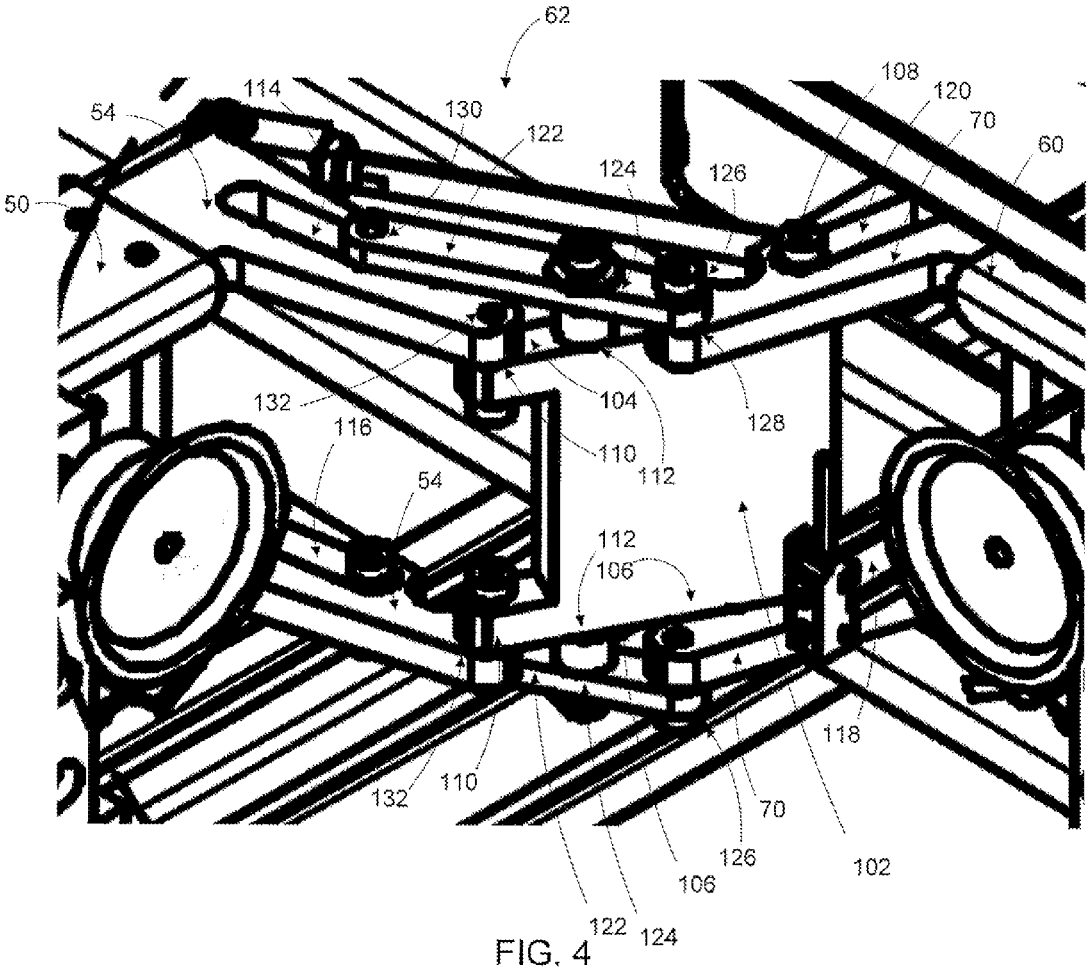
FIG. 4 depicts one embodiment of a hinge unit.

FIG. 4 depicts one embodiment of a hinge unit 62. The hinge unit 62 includes a central plate 102 that is positioned between the picker arm 24 and the erector arm 26. The central plate 102 is substantially rectangular or square in shape and includes a top side 104 and a bottom side 106. Each of the top side 104 and bottom side 106 of the central plate 102 includes end openings 108 and 110 positioned near the ends of top and bottom sides 104, 106 and a central opening 112 positioned between the two end openings. Each opening 108, 110 and 112 is sized to accommodate a screw or pin. Each of the extension arms 54, 70 on the picker arm 24 and the erector arm 26 include slots 114, 116, 118 and 120 which are configured to engage screws or pins. The slots 114, 116, 118 and 120 are arranged in the extension arms 54, 70 such that the erector arm 26 swings out and away from the picker arm 24 when the erector arm is moved.

The central plate 102 is rotatably coupled to each of the extension arms 70 on the picker arm 24 by positioning the central plate 102 between the extension arms 70 and aligning the slots 118 and 120 in the extension arms 70 with end openings 108 on the top side 104 and bottom side 106 of the central plate 102. A screw or pin passes though each slot 118 and 120 in the extension arm 70 to engage the openings 108 on the central plate 102.

Guide plates 122 are then rotatably affixed to the central opening 112 on the top and bottom sides 104, 106 of the central plate 102 by passing a screw or pin through a central opening 124 in each guide plate 122 which engages the central opening 112 on the top and bottom sides 104, 106 of the central plate 102. The guide plates 122 are rotatably affixed to the extension arm 70 by passing a screw or pin through a first end opening 126 on the guide plates 122 which engages an end opening 128 at the end of the extension arms 70. A second end opening 130 on the end of the guide plates 122 opposite the first end opening 126 engages the slots 114 and 116 in the extension arm 54 by passing a screw or pin through second end opening 130. The end openings 110 on the central plate 112 are similarly rotatably connected to end openings 132 at the end of each extension arm 54.

In this manner, after the picker and erector assembly 22 removes a collapsed case from the magazine unit 12, movement of the erector arm 26 from a position that is generally collinear to the picker arm 24 to a position that is generally transverse to the picker arm 24 causes the collapsed case to expand into the shape of a box.

Figure 5:
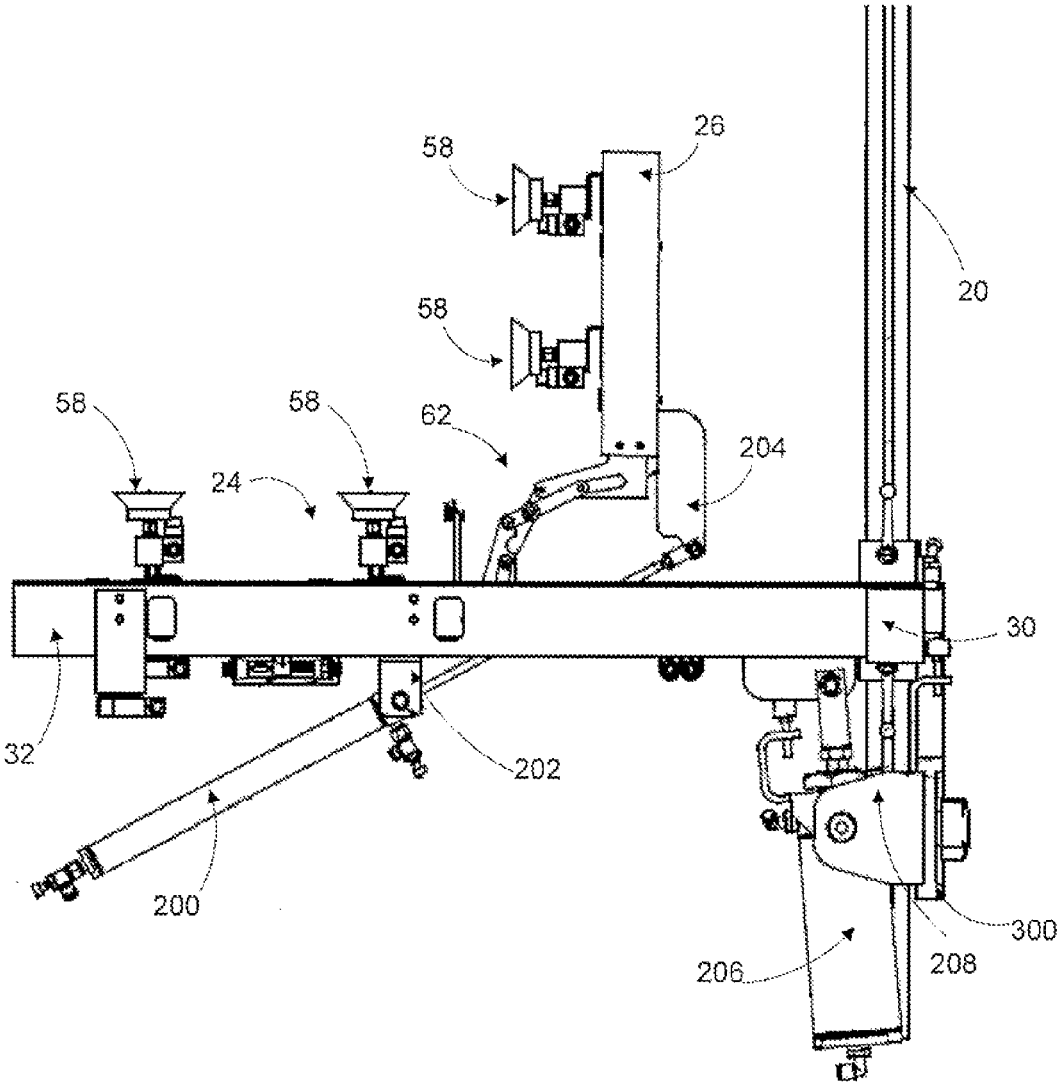
FIG. 5 depicts a top view of one embodiment of a picker and erector assembly.

FIG. 5 depicts a top view of one embodiment of the picker and erector assembly 22. The actuator 200 is secured to the exterior support frame 32 of the picker and erector assembly 22 by a bracket 202 affixed to the back side of the exterior support frame 32. The actuator 200 is angled in relation to the exterior support frame 32 of the picker and erector assembly 22. One end of the actuator connects to one side of the erector arm 26 by a rotational plate 204. The rotational plate 204 is configured to pull the erector arm 26 towards the picker and erector assembly 22 when the actuator 200 retracts and to push the erector arm 26 to a position approximately orthogonal to the picker arm 24 when the actuator 200 extends.

As the actuator 200 pushes the erector arm 26 to a position orthogonal to the picker arm 24, the hinge unit 62 extends to push the erector arm 26 outward while simultaneously rotating the erector arm 26 to a position orthogonal to the picker arm 24. During retraction of the actuator 200, the hinge 62 pulls the erector arm 26 towards the end of the picker arm 24 such that the erector arm 26 is collinear with the picker arm 24.

Figure 6:
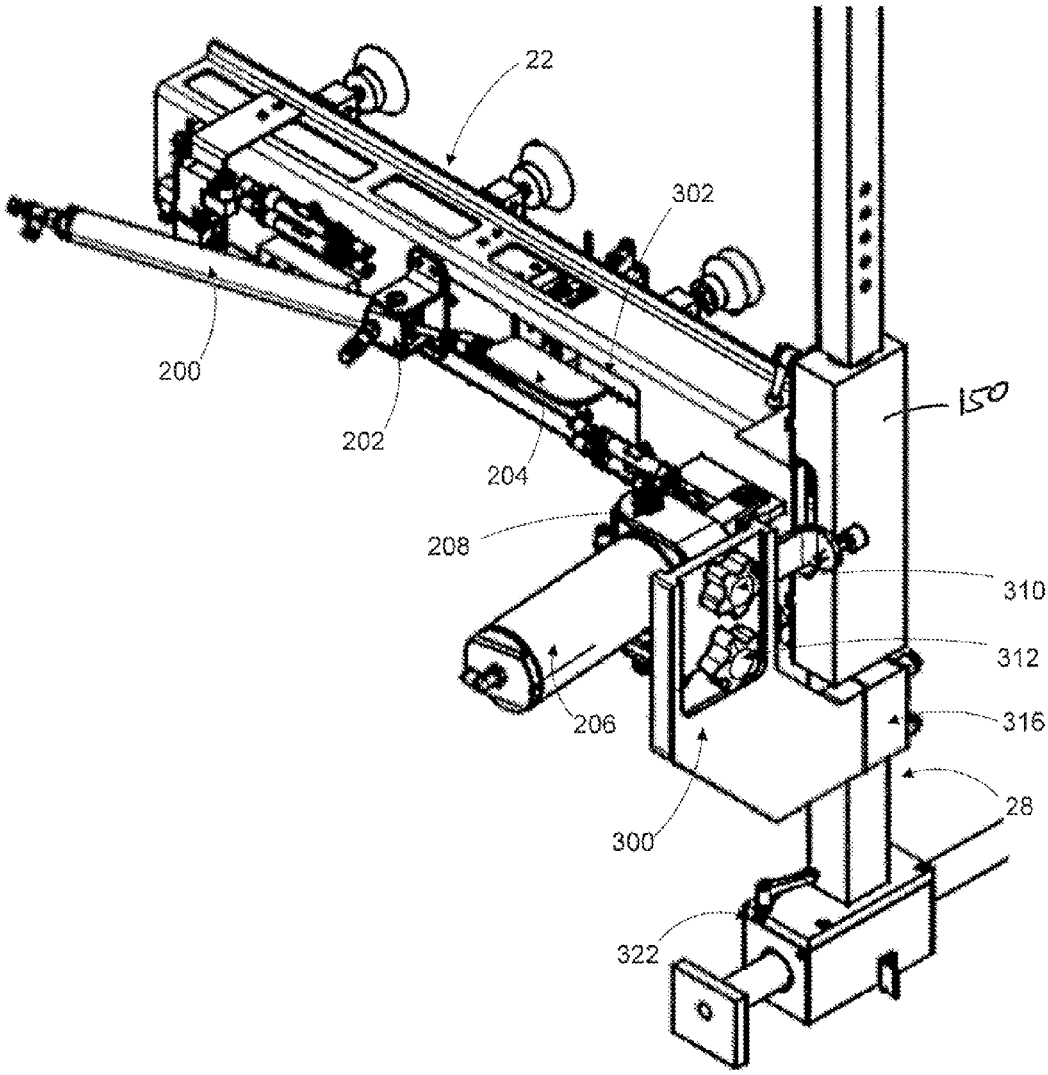
FIG. 6 depicts a rear view of a picker and erector assembly.

FIG. 6 depicts a rear view of one embodiment of the picker and erector assembly 22. As the figure depicts, the picker and erector assembly 22 is rotatably affixed the mounting assembly 28 using the mounting bracket 150 as described above. In this embodiment, mounting assembly 28 extends from the track 20 on one end to either a portion of frame 10 or to another track 20 (as described above) on the other end.

An opening 302 is provided through the exterior support frame 32 of the picker and erector assembly 22 through which one end of the actuator 200 extends. A bracket 202 that is secured to the exterior support frame 32 affixes the actuator 200 to the picker and erector assembly 22 to fully support the actuator 200 on the picker and erector assembly 22.

A piston (or "piston unit") 206 is affixed to one end of the picker and erector assembly 22 by a piston mounting bracket 208. The piston mounting bracket 208 includes a substantially "C" shaped collar which is sized to accommodate the piston 206. The back side of the "C" shaped collar portion connects to the upper portion of a piston holding plate 300 by at least two detachable locking units 310 and 312. The piston 206 is configured to rotate the picker and erector assembly 22 around the axle 40 of the mounting assembly 28.

Figure 7:
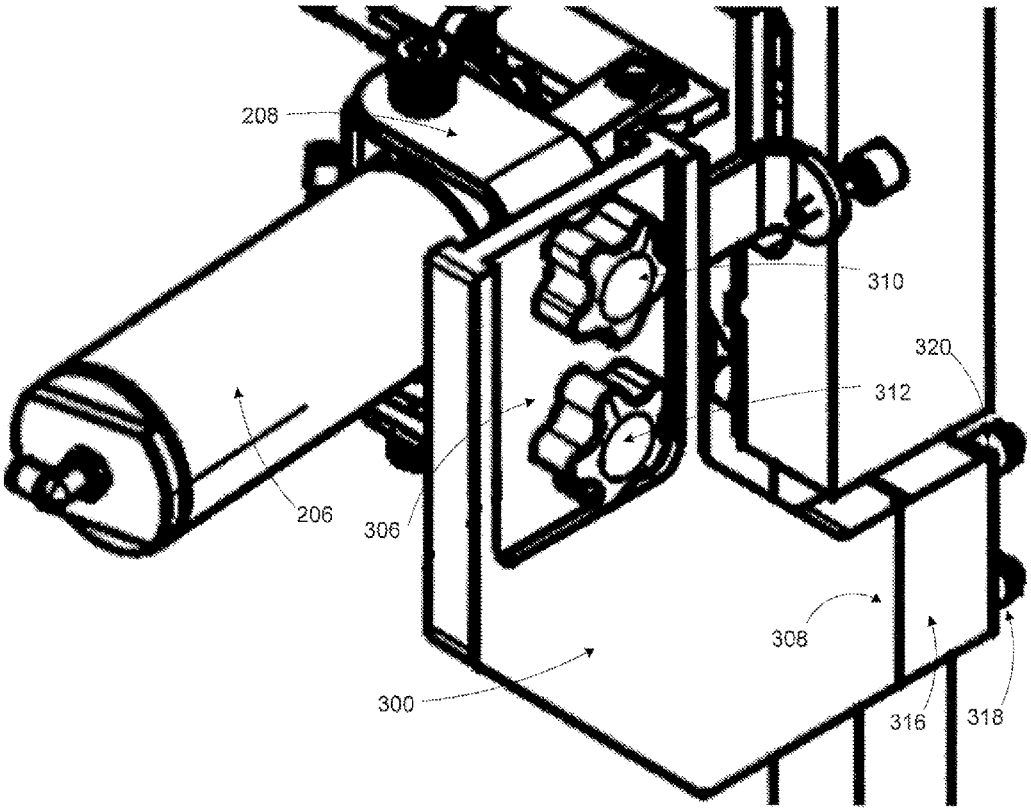
FIG. 7 depicts one embodiment of piston mounting assembly.

FIG. 7 depicts one embodiment of the piston mounting assembly. The front end of the piston 206 is connected to the piston mounting bracket 208. The side of the piston mounting bracket 208 furthest from the picker and erector assembly 22 is detachably affixed to a piston holding plate 300. The piston holding plate 300 includes an upper mounting portion 306 and a side mounting portion 308. The upper mounting portion 306 includes a recessed region sized to accommodate the side of the piston mounting bracket 208. Two piston plate locking units 310 and 312 are positioned in the recessed area of the upper portion 306 such that the two securing mechanisms engage openings in the upper mounting portion 306 and in the piston mounting bracket 208. The securing mechanism may include, but is not limited to, a knob, a pin or any other mechanism which will secure the upper mounting portion 306 to the piston mounting bracket 208.

The side mounting portion 308 is detachably affixed to an extension unit 316 on the side of the lower portion 42 of the mounting assembly 28 furthest from the picker and erector assembly 22. The extension unit 316 includes two openings extending through the entirety of the extension unit 316. Two securing knobs 318 and 320 secure the piston holding plate to the mounting bracket by engaging the openings in the extension unit 316 and the openings in the side mounting portion 308.

The piston 206 is configured to rotate picker and erector assembly 22 around the axle 40 of the mounting assembly 28, thereby swinging the picker arm 24 and erector arm 26 from the side of the case erector 1 (a position generally parallel to the side of the case erector 1) to the front of the case erector 1 (a position generally transverse to the side of the case erector 1). In this manner, the picker and erector assembly 22 is able to remove a collapsed case from the magazine unit 12 and then swing out of the path of the opened case so it can be pushed forward by the pusher bar assembly 400 (as further discussed below).

As shown in FIG. 6 and FIGS. 8A-8D, mounting assembly 28 preferably is formed with a track engaging member 322 at its lower end configured to engage the track 20 and to permit the mounting assembly 28 to be slidably moved along the track 20, from one side of case erector 1 to the other side of case erector 1. The track engaging member 322 is further configured to lockably engage the track 20 when the mounting bracket 28 is positioned in the desired position on the track 20 (in the embodiment of picker and erector assembly 22 shown in FIG. 6, it will be appreciated by those skilled in the art that a similar track engaging configuration can be used to engage an upper portion mounting assembly 28 with a second track 20, as discussed above).

FIGS. 8A-8D depict reconfiguration (from a left handed configuration to a right handed configuration) of one embodiment of the picker and erector assembly 22 and the mounting assembly 28.

FIG. 8A depicts the picker and erector assembly 22 in the left handed configuration. To reconfigure the picker and erector assembly 22 into a right handed configuration, the securing knobs 318 and 320 and the piston plate locking units 310 and 312 are removed to disengage the piston holding plate 300 from the mounting assembly 28 and the piston mounting bracket 208 allowing the picker and erector assembly 22 to be removed from the mounting assembly 28 as shown in FIG. 8B.

Figure 8C:
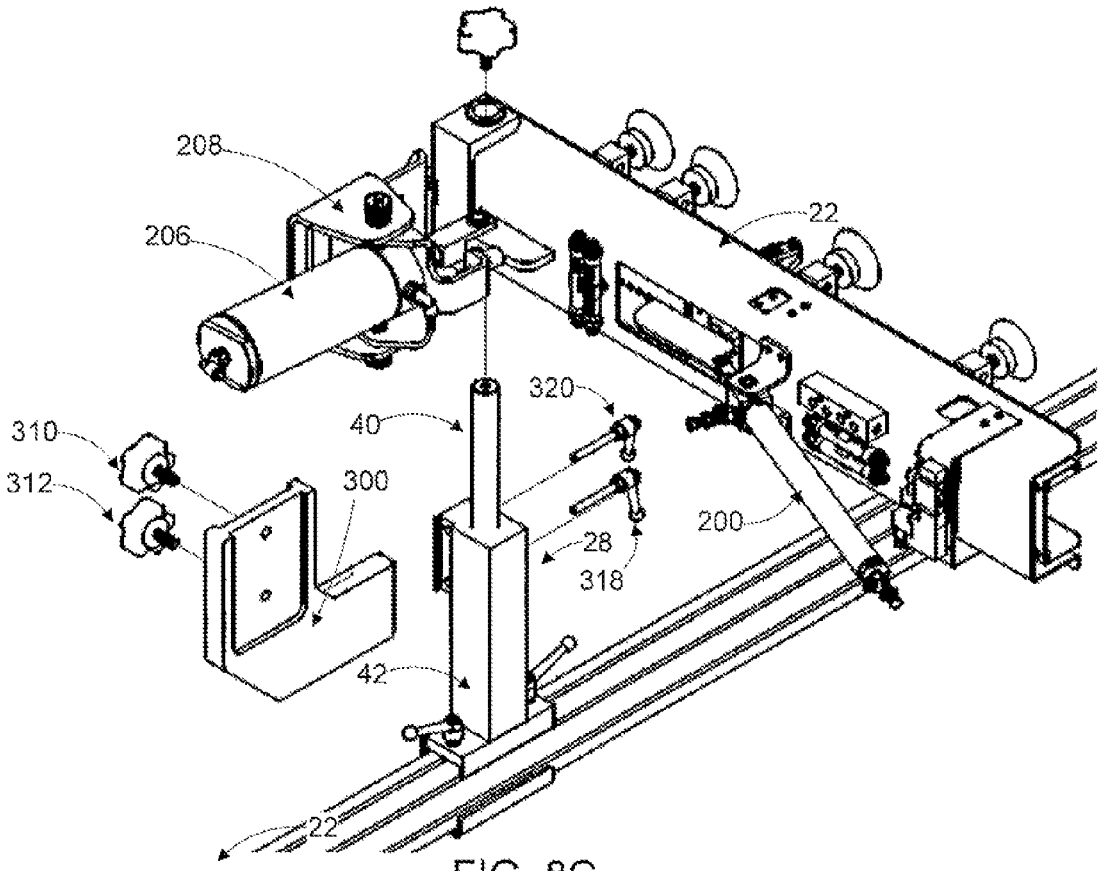

FIG. 8C depicts the picker and erector assembly 22 being rotated about an axis parallel to the exterior support frame 32 such that the suction units 56 are rotated 180 degrees from their position in the left handed configuration. FIG. 8C depicts the attachment of the picker and erector assembly 22 onto the axle 40 of the mounting assembly 28 after the picker and erector assembly 22 is rotated. Once the picker and erector assembly 22 is positioned on the axle 40 of the mounting assembly 28, the securing mechanism 30 affixes the picker and erector assembly 22 to the axle 40 of the mounting assembly 28.

Figure 8D:
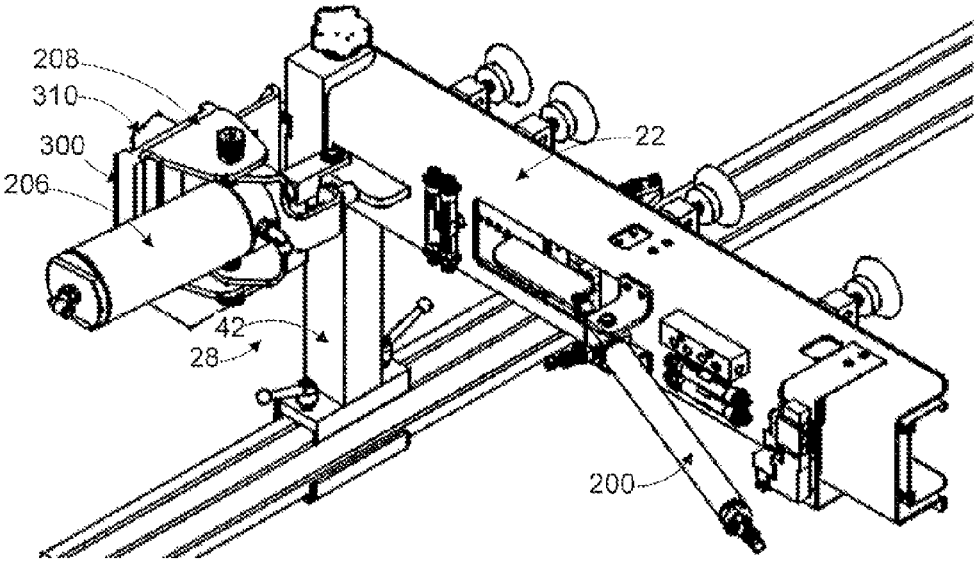

Next, the piston holding plate 300 is rotated such that the upper portion of the piston holding plate 300 engages the piston mounting bracket 208 and the side mounting portion 306 of the piston holding plate 300 engages the extension unit on the side of the mounting assembly 28. The piston mounting bracket 208 is then secured to the lower portion 42 of the mounting assembly 28 by the securing knobs 318 and 320 and to the piston mounting bracket 208 by piston plate locking units 310 and 312. FIG. 8D depicts the picker and erector assembly 22 in the right handed configuration.

Those skilled in the art will recognize that reconfiguration of the other embodiments of the picker and erector assembly 22 and mounting assembly 28, such as the embodiment depicted in FIG. 3 can be accomplished in a manner similar to what is described above. For example, for the embodiment of picker and erector assembly 22 and mounting assembly depicted in FIG. 3, the same general steps can be followed with the primary difference being that the picker and erector assembly 22 is removed from the mounting bracket 150 (using handle screws 151), reversed, and reattached to the mounting bracket 150 (using handle screws 151) while the mounting bracket 150 remains engaged with the axle 40 of mounting assembly 28.

Because the key components of the picker and erector assembly 22 are all attached to the picker and erector assembly 22 itself, the process of reconfiguring the case ejector system to accommodate different configurations of boxes is simplified. Specifically, only the piston holding plate 300 and the picker and erector assembly 22 are removed to reconfigure the case erector system from a right-handed configuration to a left-handed configuration and vice versa. Because of this arrangement, fewer man hours are expended reconfiguring the case erector system for different box configurations.

Figure 9A:
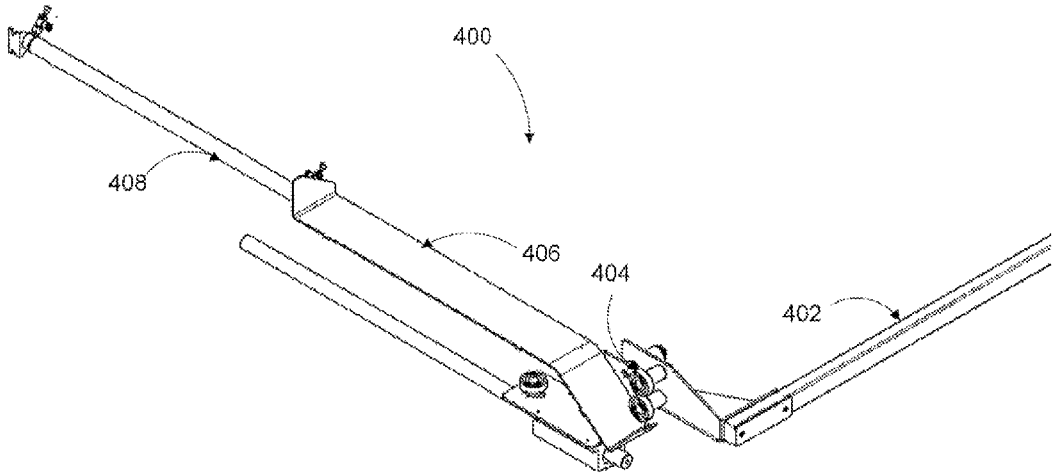
FIG. 9A depicts one embodiment of a pusher bar assembly.

FIG. 9A depicts one embodiment of a pusher bar assembly 400. Pusher bar assembly 400 preferably is mounted to frame 10 of case erector 1 and is disposed beneath the picker and erector assembly 22. This allows the picker and erector assembly 22 not only to freely operate without interference from pusher bar assembly 400, but also allows for positioning of picker and erector assembly 22 on either side of the case erector 1 accommodate "A" type cases and "B" type cases as discussed herein.

In the disclosed embodiment, pusher bar assembly 400 comprises a pusher bar 402 that extends in a direction transverse to the sides of the case erector 1. One end of pusher bar 402 comprises a cam follower 404 configured to engage a cam 406. When pusher bar 402 is drawn rearward (toward the back of case erector 1), preferably by a actuator 408, the cam follower 404 engages the cam 406 and causes the pusher bar 402 to first rise upward from beneath picker and erector assembly 22 and to then engage the open case and to push it to the next section of the case erector 1 for further processing.

Figure 9B:
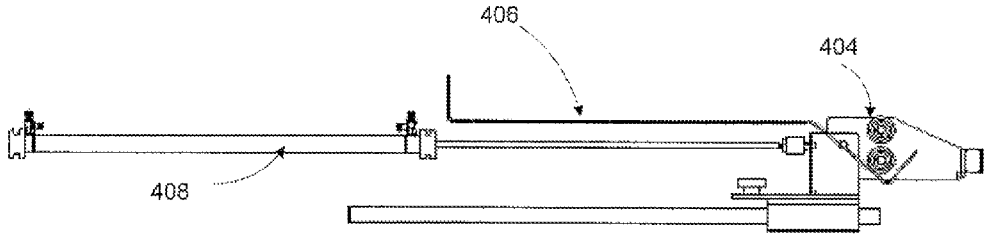
FIG. 9B depicts a side view of one embodiment of a pusher bar assembly.

FIG. 9B depicts a side view of one embodiment of the pusher bar assembly 400. The actuator 408 is connected to a lower portion of the cam follower 404. When the actuator 408 retracts, the push bar 402 is pulled over the cam 406 causing the push bar 402 to move up and back towards the actuator 408. When the actuator 408 extends, the push bar 402 is pushed away from the actuator to a position below the picker and erector assembly 22.

Figure 9C:
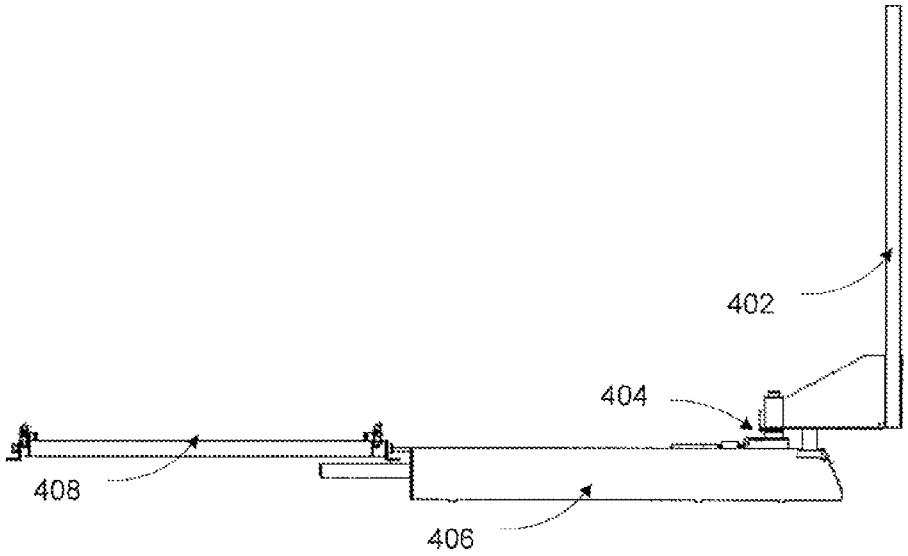
FIG. 9C depicts a top view of the pusher bar assembly.

FIG. 9C depicts a top view of the pusher bar assembly 400. Because pusher bar assembly 400 is disposed beneath the path of the picker and erector assembly 22, the picker and erector assembly 22 may be located on either side of the case erector 1 without interfering with the operation of the pusher bar assembly 402.

Operation of the case erector with reversible picker and erector assembly 1 of the present invention is illustrated and described generally in FIGS. 10A-10H. In the first step, shown as a top view in FIG. 10A and as a side view in FIG. 10B, picker and erector assembly 22 is pivotally rotated toward the front of case erector 1 such that suction cups 58 of picker arm 24 and erector arm 26 engage a collapsed case 620 from a plurality of collapsed cases 500 in the magazine unit 12. Suction then is applied to attach suction cups 58 to case 620.

Figure 10A:
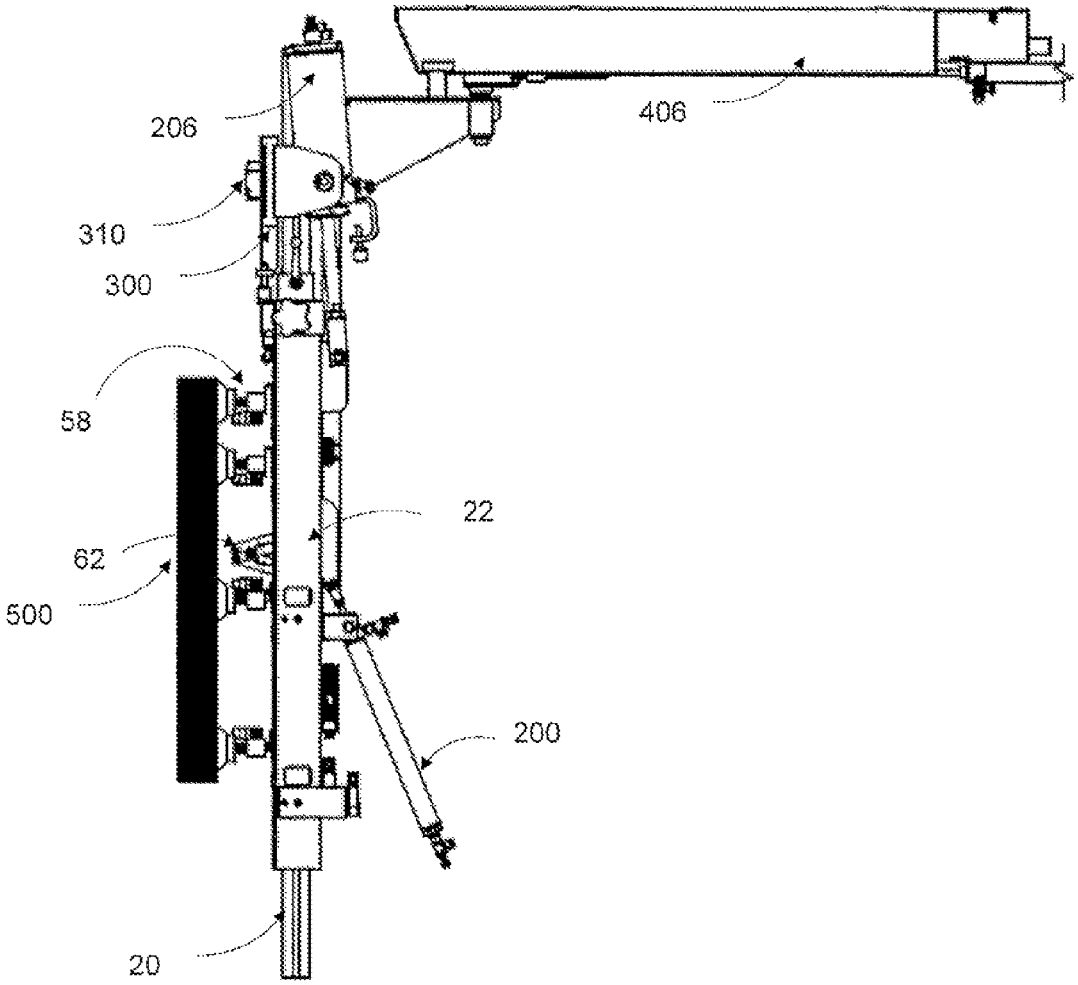
Figure 10B:
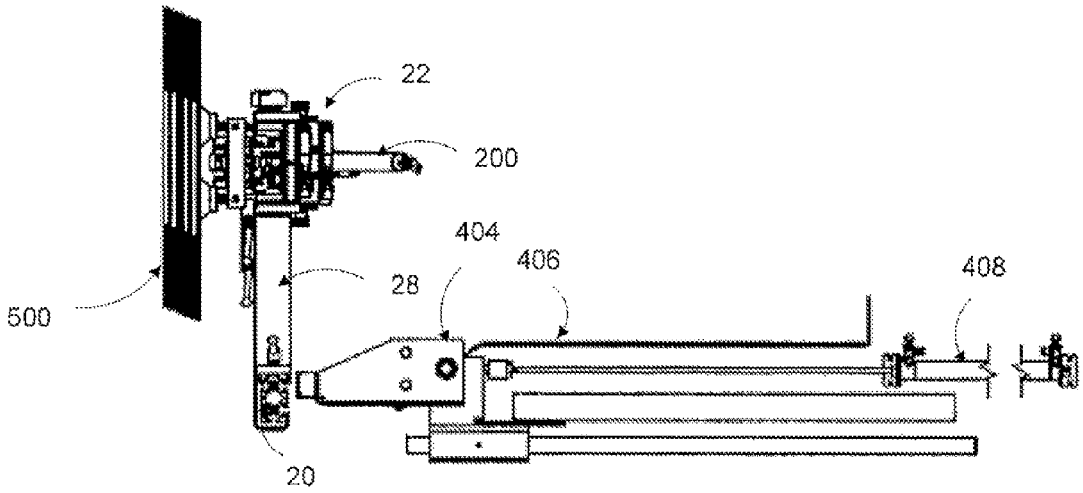
Figure 10C:
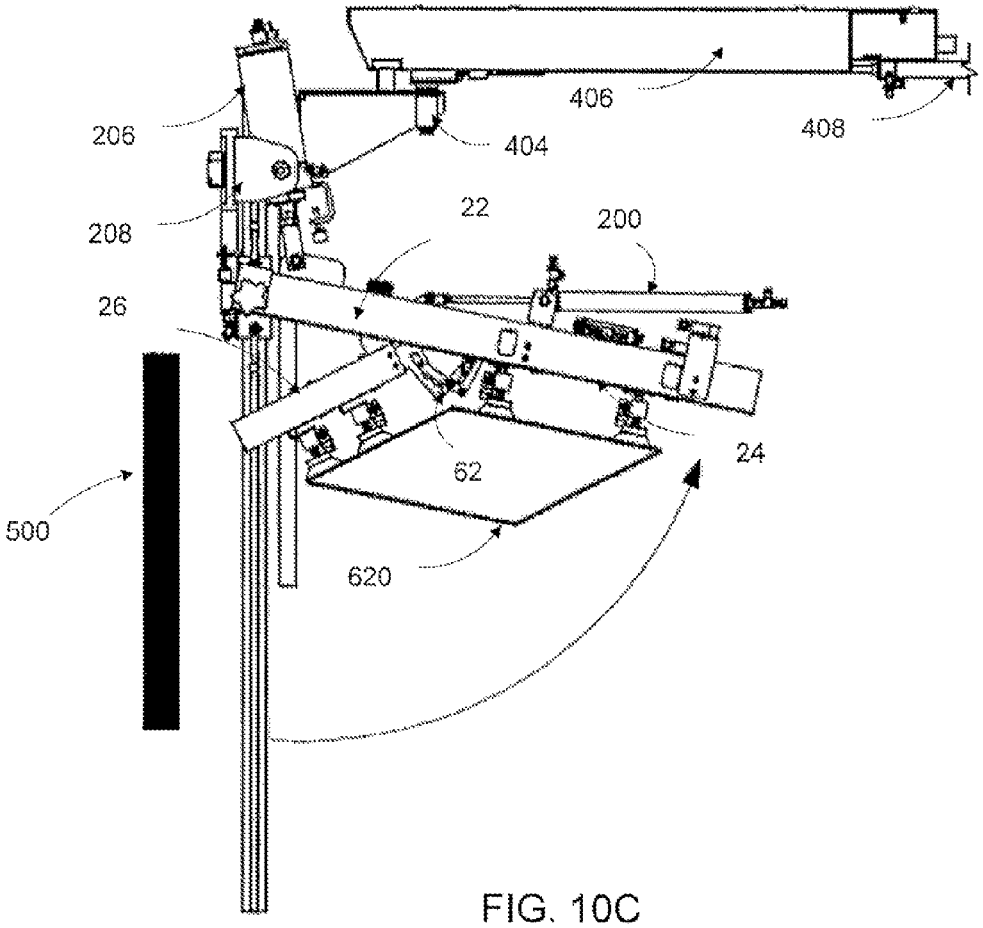
Figure 10D:
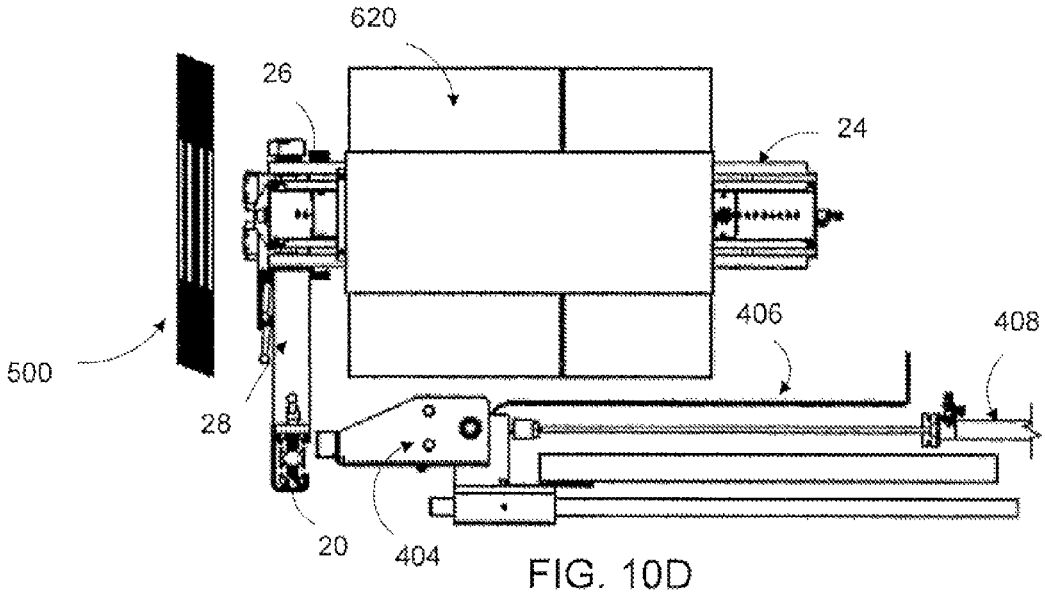

As shown as a top view in FIG. 10C and as a side view in FIG. 10D, picker and erector assembly 22 is then pivotally rotated away from the front of case erector 1 and towards the side of case erector 1 by the piston 206. At the same time, the actuator 200 extends which pushes the erector arm 26 away from picker and erector assembly 22 towards a position that is transverse to picker and erector assembly 22 and picker arm 24. This movement causes the case 620 to begin to open.

Figure 10E:
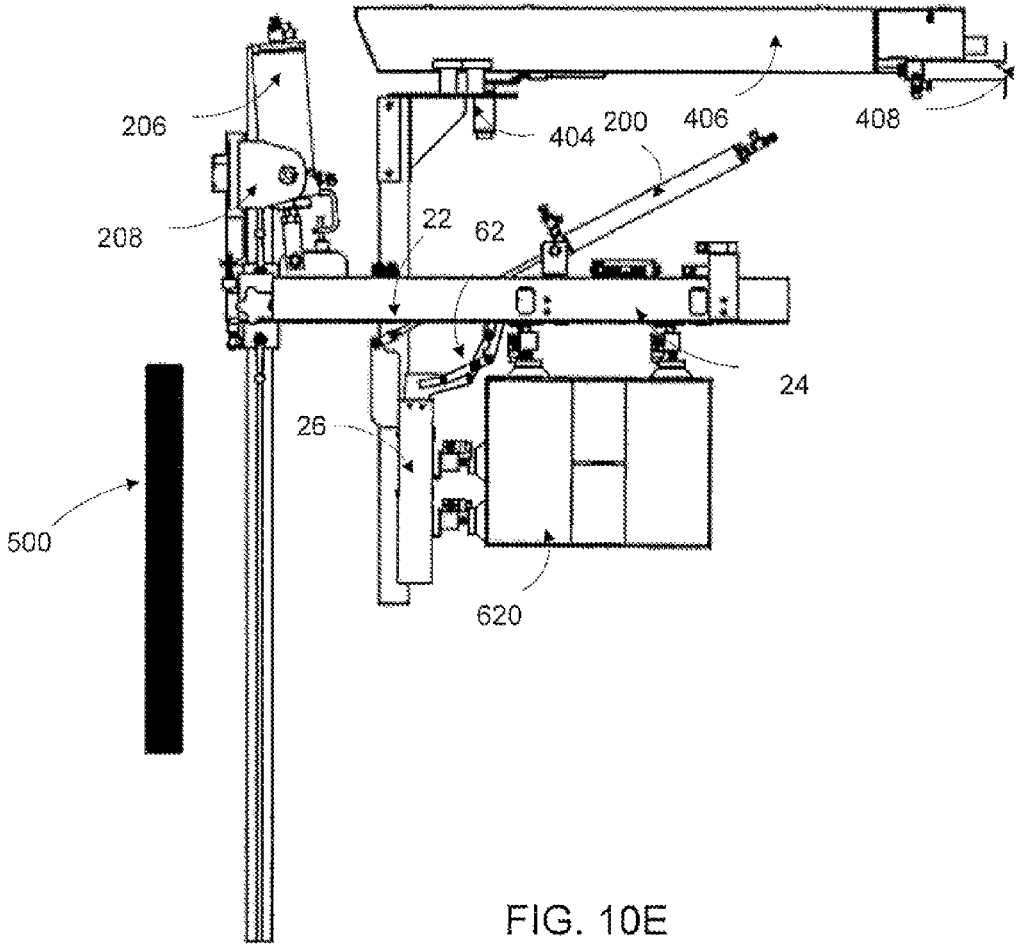
Figure 10F:
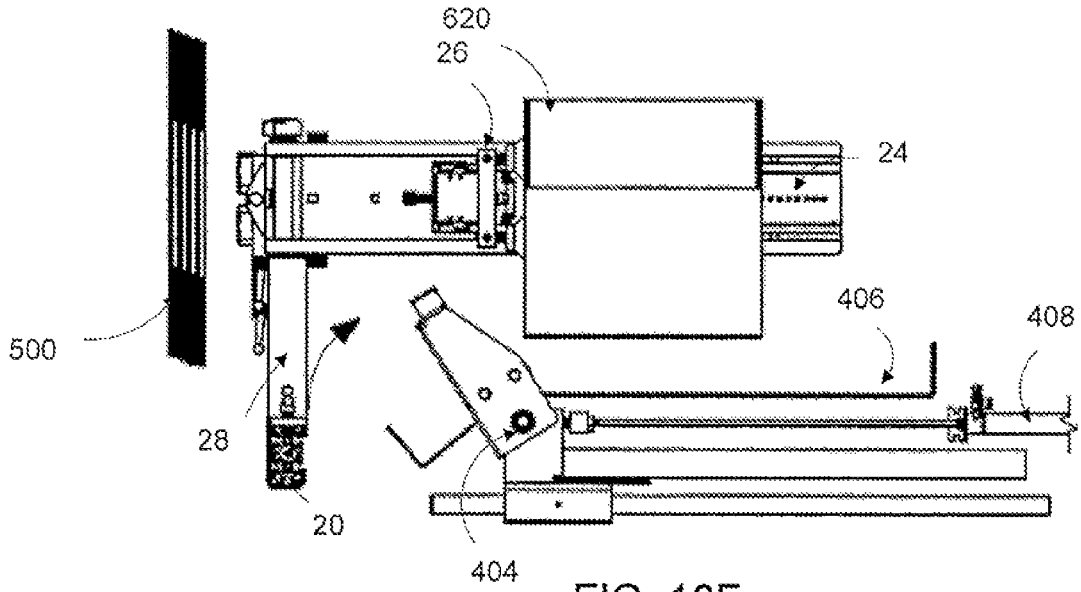

As shown as a top view in FIG. 10E and as a side view in FIG. 10F, once erector arm 26 is full extended and disposed in a position generally transverse to picker and erector assembly 22 and picker arm 24, picker and erector assembly 22 has retracted to a position generally parallel with the side of case erector 1, thus positioning now-fully-opened case 620 in a position to be engaged by pusher bar 402 of pusher bar assembly 400.

Figure 10G:
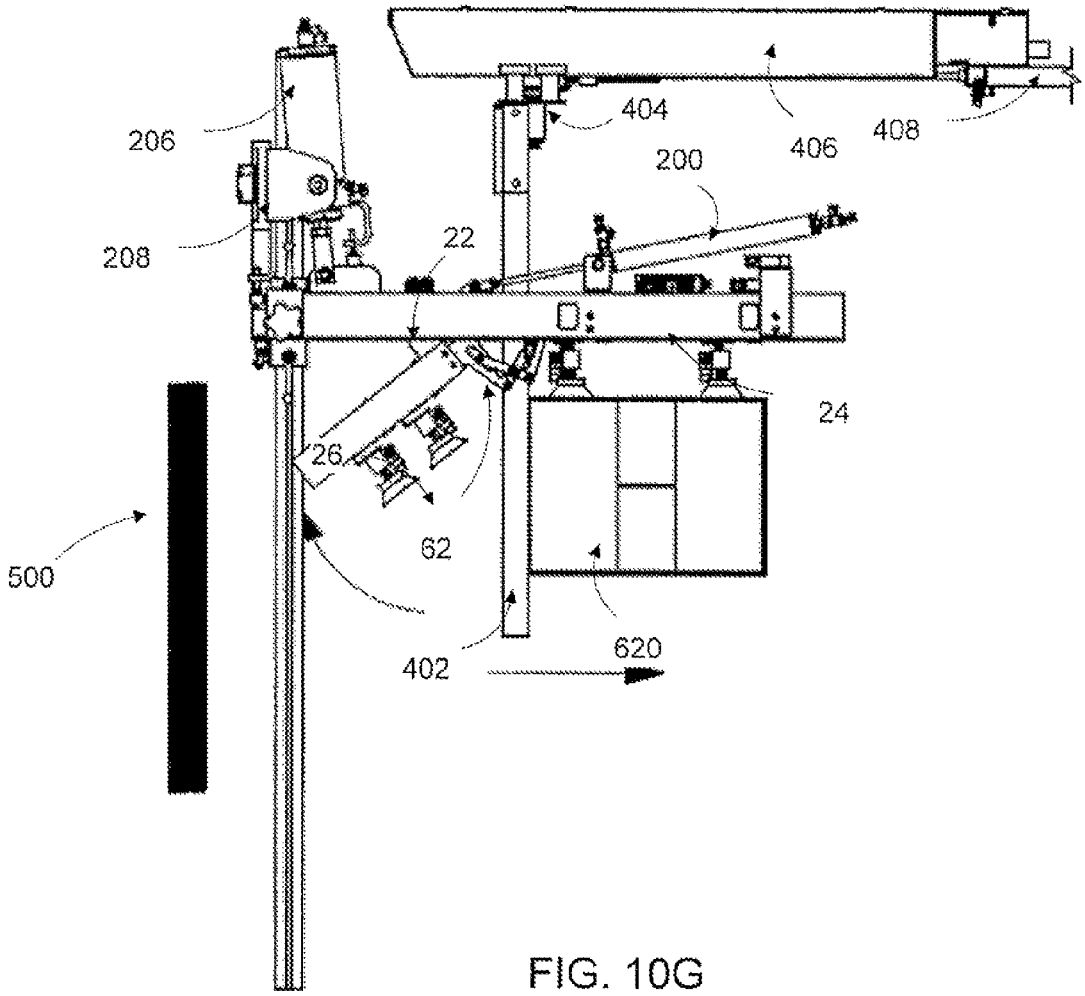

As shown as a top view in FIG. 10G and as a side view in FIG. 10H, at this point the suction applied to suction cups 58 is ceased and the actuator 200 retracts, pulling the erector arm 26 to its starting position generally collinear with picker arm 24. At the same time, actuator 408 pulls the pusher bar assembly 400 in a direction away from the track 20 such that the pusher bar 400 engages the now-formed case 620. The pusher bar is raised to a level where the front surface of the pusher bar is in contact with a lower portion of the case 620 to push the case towards the back of the case erector 1 for further processing.

Once the case 620 moves beyond the maximum travel of the pusher bar 402, the actuator 408 extends pushing the pusher bar 402 in a direction towards the track 20. Once the pusher bar 402 is pushed back below the picker and erector assembly 22, the piston 206 pulls the picker and erector assembly 22 back to a position parallel with the track 20. The picker and erector assembly 22 then engages another case from the plurality of cases 500 in the magazine unit 12 and the process continues.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A case erector system, comprising:

a track;

a mounting unit slidably affixed to the track, the mounting unit comprising an axle;

an integrated picker and erector unit removably and reversibly affixed to the mounting unit such that the picker and erector unit when oriented in a first direction in a first configuration may be removed from the mounting unit, oriented in a second direction opposite the first direction, and reattached to the mounting unit in the second direction to form a second configuration;

an erector arm unit in the picker and erector unit configured to engage a first side of a case unit; and a picker arm unit in the picker and erector unit configured to engage a second side of the case unit, wherein the erector arm unit is configured to move from a position generally parallel to the picker arm unit to a position generally transverse to the picker arm unit while both the picker arm unit and erector arm unit engage the case unit, and wherein the picker and erector unit is freely rotatable about the axle and opens a first type of case in the first configuration and a second type of case in the second configuration.

2. The case erector system of claim 1 further comprising an actuator affixed to the picker and erector unit and the erector arm unit, the actuator configured to move the erector arm unit relative to the picker and erector unit.

3. The case erector system of claim 1 further comprising a piston unit affixed to the picker and erector unit, the piston unit configured to move the picker and erector unit between a first position which engages the case unit and a second position which erects the case unit.

4. The case erector system of claim 1 wherein the picker arm unit comprises a plurality of suction devices capable of engaging and disengaging the second side of the case unit.

5. The case erector system of claim 1 wherein the erector arm unit comprises a plurality of suction devices capable of engaging and disengaging the first side of the case unit.

6. The case erector system of claim 1 wherein movement of the erector arm unit relative to the picker arm unit while engaged with the case unit erects the case unit.

7. The case erector system of claim 1 further comprising a pusher bar configured to push the case unit in a direction away from the picker and erector unit.

8. The case erector system of claim 7 wherein the pusher bar is retractable to a position below the picker and erector unit.

9. The case erector system of claim 1 wherein the picker and erector unit erects the case unit to the right in the first configuration and erects the case unit to the left in the second configuration.

10. The case erector system of claim 1 wherein the picker and erector unit further comprises a hinge unit that rotatably couples the erector arm unit and picker arm unit.

11. A method for erecting a case, the method comprising the steps of:

providing a case erector system, the case erector system comprising a track, a mounting unit slidably affixed to the track and comprising an axle, an integrated picker and erector unit removably and reversibly affixed to the mounting unit such that the picker and erector unit when oriented in a first direction in a first configuration may be removed from the mounting unit, oriented in a second direction opposite the first direction, and reattached to the mounting unit in the second direction to form a second configuration, an erector arm unit in the picker and erector unit configured to engage a first side of the case, and a picker arm unit in the picker and erector unit configured to engage a second side of the case, wherein the erector arm unit is configured to move from a position generally parallel to the picker arm unit to a position generally transverse to the picker arm unit while both the picker arm unit and erector arm unit engage the case and wherein the picker and erector unit is freely rotatable about the axle and opens a first type of case in the first configuration and a second type of case in the second configuration;

rotating the picker and erector unit to select the case from a plurality of un-erected cases;

engaging the case with the picker arm unit and the erector arm unit;

moving the picker and erector unit away from the plurality of un-erected cases while simultaneously moving the erector arm unit away from the picker arm unit to erect the case.

12. The method of claim 11, further comprising the step of moving the erected case away from the picker and erector unit after the case is erected.

13. The method of claim 11 wherein the picker arm unit engages the case using suction devices.

14. The method of claim 11 wherein the erector arm unit engages the case using suction devices.

15. The method of claim 12 wherein the step of moving the erected case comprises the steps of:

raising a pusher bar from beneath the picker and erector unit to a height where the pusher bar is in contact with a lower portion of the case;

moving the pusher bar in a first direction away from the picker and erector unit;

moving the pusher bar in a second direction towards the picker and erector unit; and lowering the pusher bar beneath the picker and erector unit.

16. The method of claim 11 further comprising the step of reconfiguring the picker and erector unit from the first configuration to the second configuration, wherein the step of reconfiguring the picker and erector unit further comprises the steps of:

removing the picker and erector unit from the mounting unit;

reversing the picker and erector unit from the first direction to the second direction; and reattaching the picker and erector unit to the mounting unit in the second direction.

17. The method of claim 16 wherein the step of removing the picker and erector unit from the mounting unit further comprises the steps of:

detaching a piston holding plate from the picker and erector unit; and detaching the piston holding plate from the mounting unit.

18. The method of claim 17 wherein the step of reattaching the picker and erector unit to the mounting unit in the second direction further comprises the steps of:

reversing the piston holding plate such that the piston holding plate faces an opposite direction;

reattaching the piston holding plate to the mounting unit in the opposite direction; and reattaching the piston holding plate to the picker and erector unit in the opposite direction.

19. A case erector, the case erector comprising:

a frame;

a reversible picker and erector assembly, the reversible picker and erector assembly comprising an integrated picker arm and erector arm;

a mounting assembly having an axle, the reversible picker and erector assembly being removably and reversibly mounted to the mounting assembly such that the picker and erector assembly when oriented in a first direction in a first configuration may be removed from the mounting assembly, oriented in a second direction opposite the first direction, and reattached to the mounting assembly in the second direction to form a second configuration; and a track, the track extending from a first side of the frame to a second side of the frame, the first side being opposite the second side, wherein the mounting assembly is slidably engaged with the track and configured to allow the reversible picker and erector assembly to be mounted on both the first side and the second side of the frame, and wherein the erector arm is configured to move from a position generally parallel to the picker arm to a position generally transverse to the picker arm while both the picker arm and erector arm engage a case and wherein the picker and erector assembly is freely rotatable about the axle and opens a first type of case in the first configuration and a second type of case in the second configuration.

20. The case erector of claim 19 further comprising a pusher bar assembly, the pusher bar assembly comprising a pusher bar configured to push a case in a direction away from the reversible picker and erector assembly, wherein the pusher bar is retractable to a location beneath the reversible picker and erector assembly.

* * * * *